US007296391B2

(12) United States Patent
Lopoukhine et al.

(10) Patent No.: US 7,296,391 B2
(45) Date of Patent: Nov. 20, 2007

(54) APPARATUS FOR PACKAGING AND SEALING

(76) Inventors: Matthew Lopoukhine, 63 Commonwealth Rd., Watertown, MA (US) 02472; Eugene R. Komar, 3 Craig Pl., Middletown, NY (US) 07748

( * ) Notice: Subject to any disclaimer, the term of this patent is extended or adjusted under 35 U.S.C. 154(b) by 0 days.

(21) Appl. No.: 11/339,911

(22) Filed: Jan. 25, 2006

(65) Prior Publication Data

US 2006/0218886 A1 Oct. 5, 2006

Related U.S. Application Data

(60) Provisional application No. 60/650,295, filed on Feb. 3, 2005, provisional application No. 60/650,304, filed on Feb. 3, 2005.

(51) Int. Cl.
*B65B 9/02* (2006.01)

(52) U.S. Cl. ..... 53/553

(58) Field of Classification Search ..... 53/553–555
See application file for complete search history.

(56) References Cited

U.S. PATENT DOCUMENTS

| | | | | | |
|---|---|---|---|---|---|
| 2,350,930 | A * | 6/1944 | Salflsberg | 53/413 |
| 2,420,983 | A * | 5/1947 | Salflsberg | 53/436 |
| 2,443,327 | A * | 6/1948 | Salflsberg | 53/436 |
| 2,612,738 | A * | 10/1952 | Salflsberg | 53/459 |
| 2,747,351 | A * | 5/1956 | Whitecar | 53/141 |
| 2,826,025 | A * | 3/1958 | Swartz | 53/554 |
| 2,828,590 | A * | 4/1958 | Swartz | 53/431 |
| 2,938,318 | A * | 5/1960 | Thomas | 53/554 |
| 4,067,173 | A * | 1/1978 | Borrello | 53/553 |
| 4,074,505 | A * | 2/1978 | Keren et al. | 53/450 |
| 4,603,540 | A * | 8/1986 | Kopp | 53/546 |
| 4,869,049 | A | 9/1989 | Richards et al. | |
| 4,996,819 | A * | 3/1991 | Davis | 53/64 |
| 4,999,968 | A * | 3/1991 | Davis | 53/133.1 |
| 5,590,512 | A | 1/1997 | Richards et al. | |
| 5,813,200 | A | 9/1998 | Jacoby et al. | |
| 6,145,283 | A * | 11/2000 | Noordenbos et al. | 53/554 |
| 6,516,588 | B2 | 2/2003 | Jensen et al. | |
| 6,719,194 | B2 | 4/2004 | Richards | |
| 6,901,974 | B2 | 6/2005 | Chomik et al. | |
| 6,925,781 | B1 | 8/2005 | Knuth et al. | |
| 2006/0214441 | A1 * | 9/2006 | Lopoukhine et al. | 294/1.4 |

FOREIGN PATENT DOCUMENTS

| | | | |
|---|---|---|---|
| DE | 3129424 | A1 * | 2/1983 |
| JP | 01-182800 | A * | 7/1989 |
| JP | 01-279006 | A * | 11/1989 |

* cited by examiner

*Primary Examiner*—Stephen F. Gerrity

(57) ABSTRACT

A sanitary refuse collecting and packaging device having a housing unit that can be positioned on or over a waste basket. The housing unit can be configured to have a door and opening for permitting entry of refuse and can include a movement mechanism, material shaft rollers for dispensing replaceable collection pouch material, formation rollers, and a cutting unit. The movement mechanism drives the formation rollers causing the refuse to be enveloped and sealed in the collection pouch material. The cutting unit thereafter severs the sealed pouch, which passes through the housing unit into the waste basket.

8 Claims, 8 Drawing Sheets

APPARATUS FOR PACKAGING AND SEALING

CROSS-REFERENCE TO RELATED APPLICATIONS

The present application claims priority to U.S. Provisional Patent Application Ser. Nos. 60/650,295 entitled APPARATUS FOR PACKAGING AND SEALING by Matthew Lopoukhine and Eugene R. Komar, filed Feb. 3, 2005, the entirety of which is hereby specifically incorporated by reference for all it discloses and teaches. The present application also claims priority to U.S. Provisional Patent Application Ser. Nos. 60/650,304 entitled APPARATUS FOR COLLECTING AND POUCHING by Matthew Lopoukhine and Eugene R. Komar, filed Feb. 3, 2005, the entirety of which is hereby specifically incorporated by reference for all it discloses and teaches.

FIELD OF THE INVENTION

The invention relates to an apparatus for allowing hands-free packaging and sealing of objects, including diapers, food, materials, and waste, by enveloping the object in material and thereafter sealing the material-enveloped object to form a sealed pouch. The sealed pouch can be stored within the apparatus until otherwise discarded or can pass through the apparatus for deposit into an external area or container.

STATEMENT AS TO RIGHT TO INVENTIONS MADE UNDER FEDERAL SPONSORED RESEARCH AND DEVELOPMENT

None

BACKGROUND OF THE INVENTION

Our population is constantly exposed to health risks. People can spread and contract serious illnesses by merely failing to wash their hands after touching seemingly innocuous items such as grocery goods, and they can develop life threatening diseases by picking up and handling improperly disposed waste. Moreover, viruses that were once thought to be confined to animals are infecting humans who come in contact with the sick animal or its waste. Public concern over sanitation is accordingly escalating and people are regularly adopting more stringent sanitary practices. This is especially true when they are disposing medical waste or even a child's diapers.

A growing market exists for disposing of various types of refuse, including diapers. Just a few diaper disposal products on the market include the Diaper Genie®, Diaper Dekor®, Diaper Champ®. In general, these products look like a waste basket and are configured to use refillable plastic cartridges or plastic bags that envelope and seal the diaper to prevent odor and the spread of germs. Not infrequently, however, the disposed diaper will puncture the bag or the cartridge fails to properly enclose seal the diaper. Moreover, they require regular replacement of the cartridges or bags.

SUMMARY OF INVENTION

The disclosed apparatus provides a convenient, sanitary and odor-less way to dispose of refuse, including diapers. Unlike known art, the disclosed apparatus integrate rolls of sanitary pouch material that envelopes and seals the enclosed waste, ensuring no germs or odors leak, and which need only infrequent replacement. The apparatus can have a housing unit, material rollers for dispensing collection material, a movement mechanism actuated via an actuation device for moving formation rollers which in turn facilitate the collection and enveloping of the object in the collection material to form a sealed pouch. At least one cutting unit for severing the sealed pouch can also be employed.

DESCRIPTION OF PREFERRED EMBODIMENTS

Figure 1:
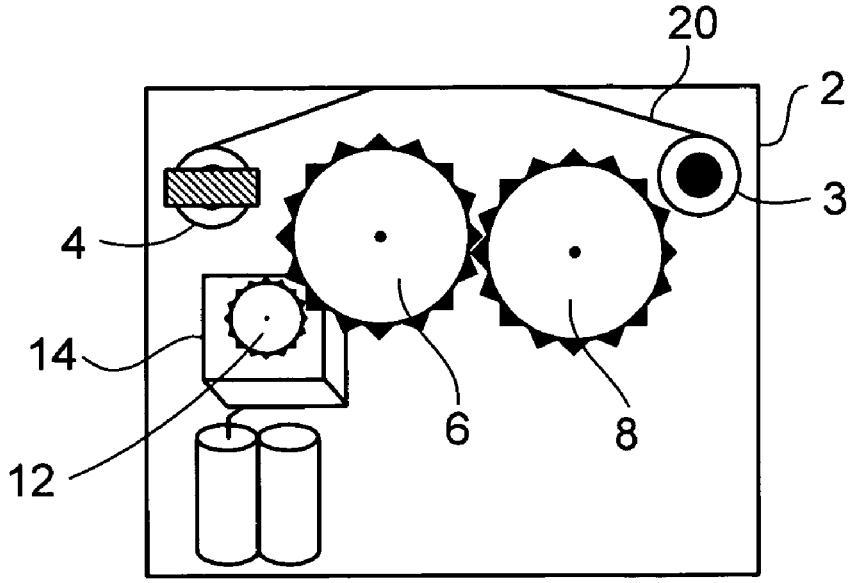
FIG. 1 is a cut-away view of the apparatus in its starting position

While the disclosed apparatus is susceptible of numerous implementations, there is shown in the drawings and herein described in further detail, exemplary implementations, with the understanding that the present disclosure is to be considered as illustrative of the principles of the apparatus and not intended to limit the invention to the exemplary embodiments shown and described.

Figure 2:
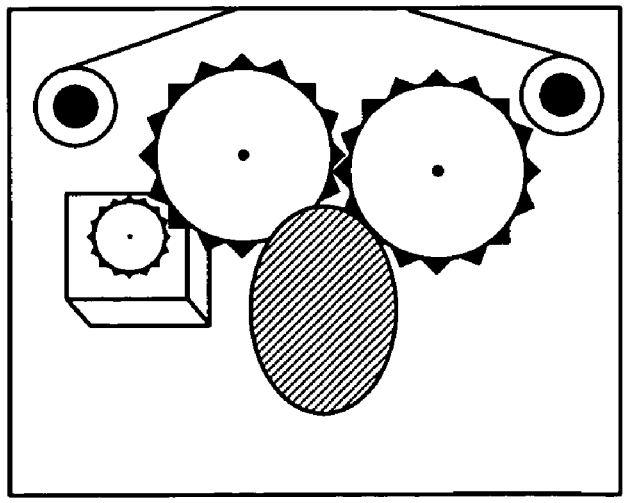
FIG. 2 is a cut-away view of the apparatus in its intermediate position
Figure 3:
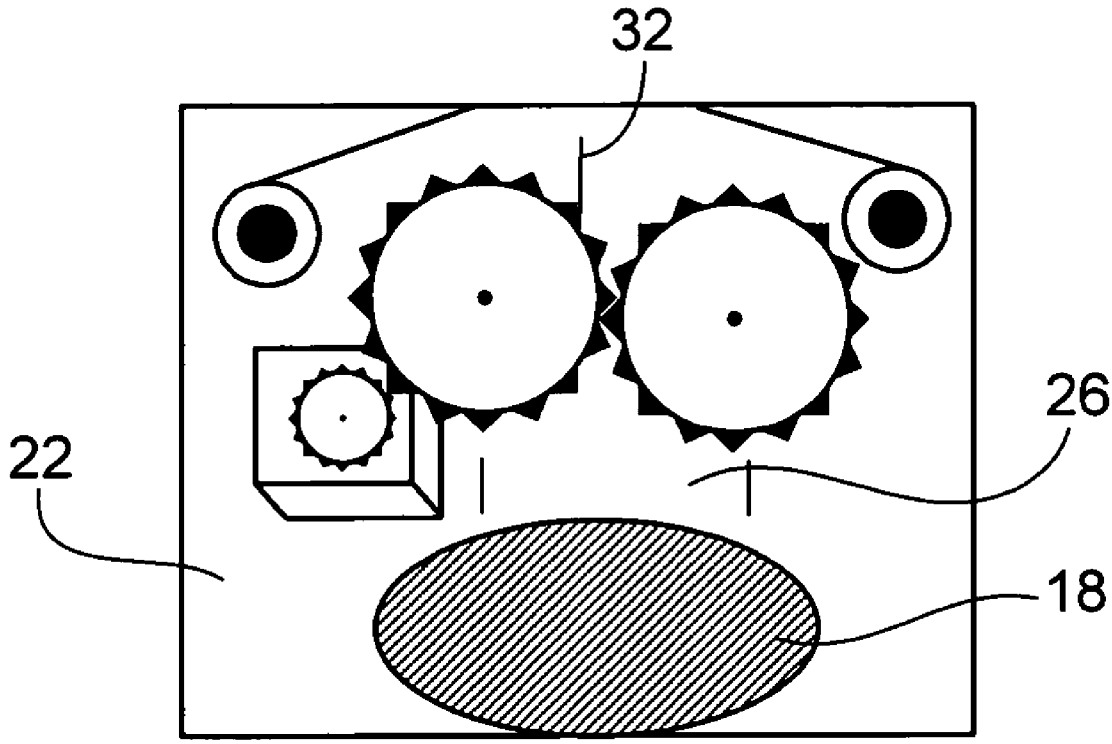
FIG. 3 is a cut-away view of the apparatus in its finished position

FIGS. 1 through 3 illustrate an implementation of the apparatus comprising a housing unit 2, material shaft rollers 3 and 4, formation rollers 6 and 8, a cutting unit 10, a movement mechanism 12, and a motor 14, all of which work in conjunction, as is more fully explained below, to package the desired object and form the sealed collecting pouch 18 that can be stored in or passed through the housing unit 2 into a separate container.

Figure 5:
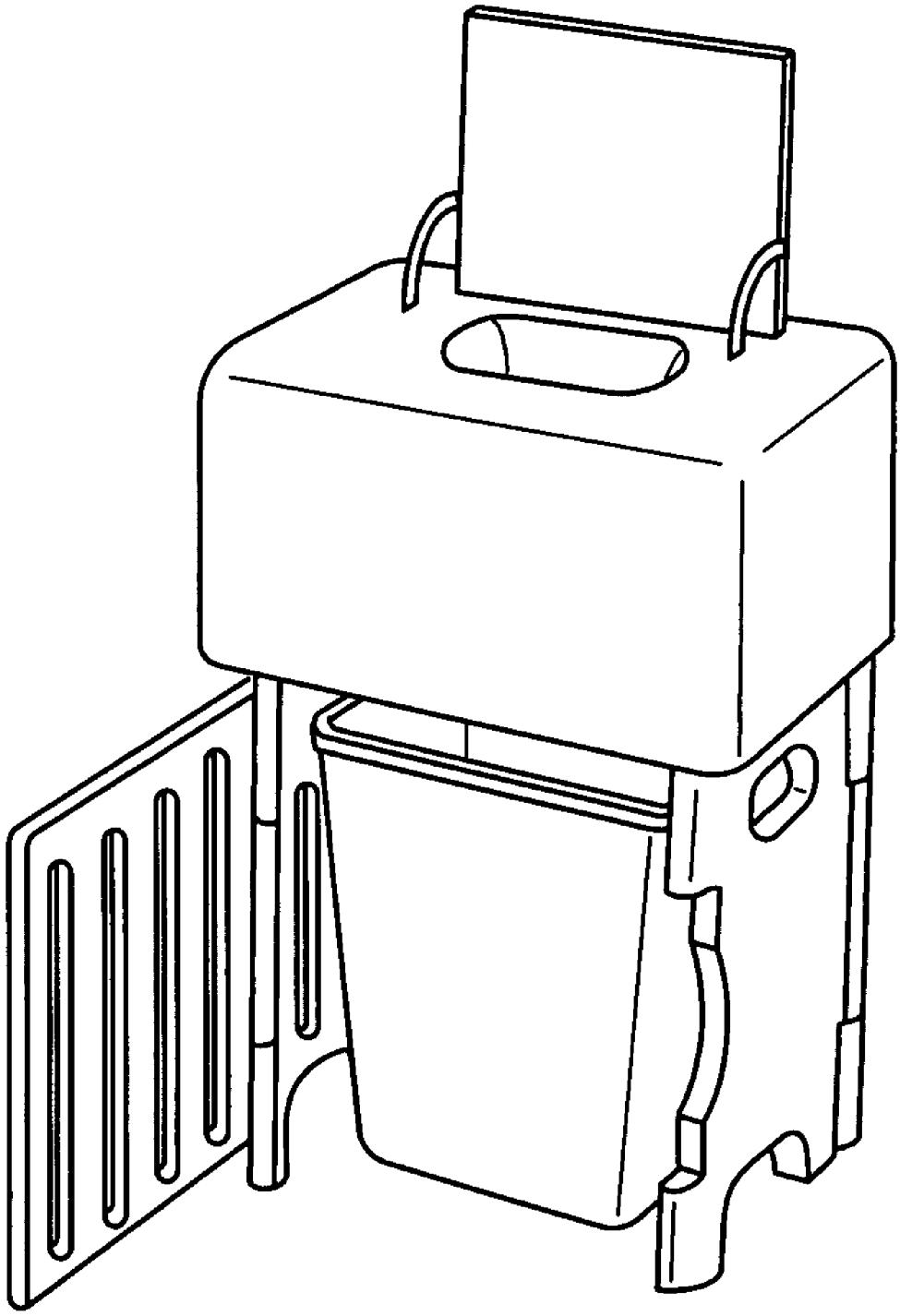
FIG. 5 is a view of the apparatus configured with a stand.

As illustrated in FIG. 5, the housing unit 2 has an opening 16 for permitting entry of the object to be sealed, and the unit can have a support stand or can be designed to fit onto or over a common container, such as a waste basket or barrel. The opening can take various shapes to assist in guiding the object into the opening, and at least one inwardly or outwardly retractable door can be employed to cover the opening. As best illustrated in FIG. 3, the housing unit 2 can also have one or more storage areas 22. Each storage area 22 can have a corresponding access opening and door 24 and each door 24 can have a grasping device 26. These storage areas 22 can be used to store used sealed collection pouches 18 or spare rolls of collection pouch material 20.

The housing unit 2 can have a chute 26 in lieu of or in addition to one or more storage areas 22 to allow the sealed pouch 18 to pass through the housing unit 2 into the container. If a chute 26 is employed, at least one door can be configured at the bottom of the housing unit 2 (where the chute 26 terminates) to permit passage of the sealed pouch into the container. The door can employ a locking device.

One or more material shaft rollers 3 and 4 facilitate the dispensing of the replaceable collection pouch material 20 and can be further configured to dispense the material 20 selectively, e.g., only once a certain tension point is created. If at least two shaft rollers 3 and 4 are employed, they can be positioned on the opposite upper sides of the housing unit 2 or at other various positions.

The collection pouch material 20, generally shaped like a continuous strip of tape or film, can be made solely of or a combination of paper, plastic, fabric or some other similar material or substance and is designed to envelope the object or waste to be collected and form a sealed pouch 18. The pouch material 20 can be wound on cardboard cylinders, much like athletic or packing tape, which are designed to rotatably ride on the material shaft rollers 3 and 4. Configuring the material on such cylinders allows a user to replace the rolls of pouch material as needed. The side of the collection pouch material 20 facing towards the opening 16 can be coated completely or in part with an adhesive substance. The adhesive substance not only assists in grasping the product/waste, but also provides the necessary adhesion for sealing the pouch, and permits the material 20 to be continuously fed even after the pouch is formed and severed, as is further discussed below. Alternatively, the pouch material 20 may be designed to have corresponding ridges that interlock and seal the pouch 8. Other configurations of the pouch material 20 may also be employed to accomplish the foregoing.

Figure 4:
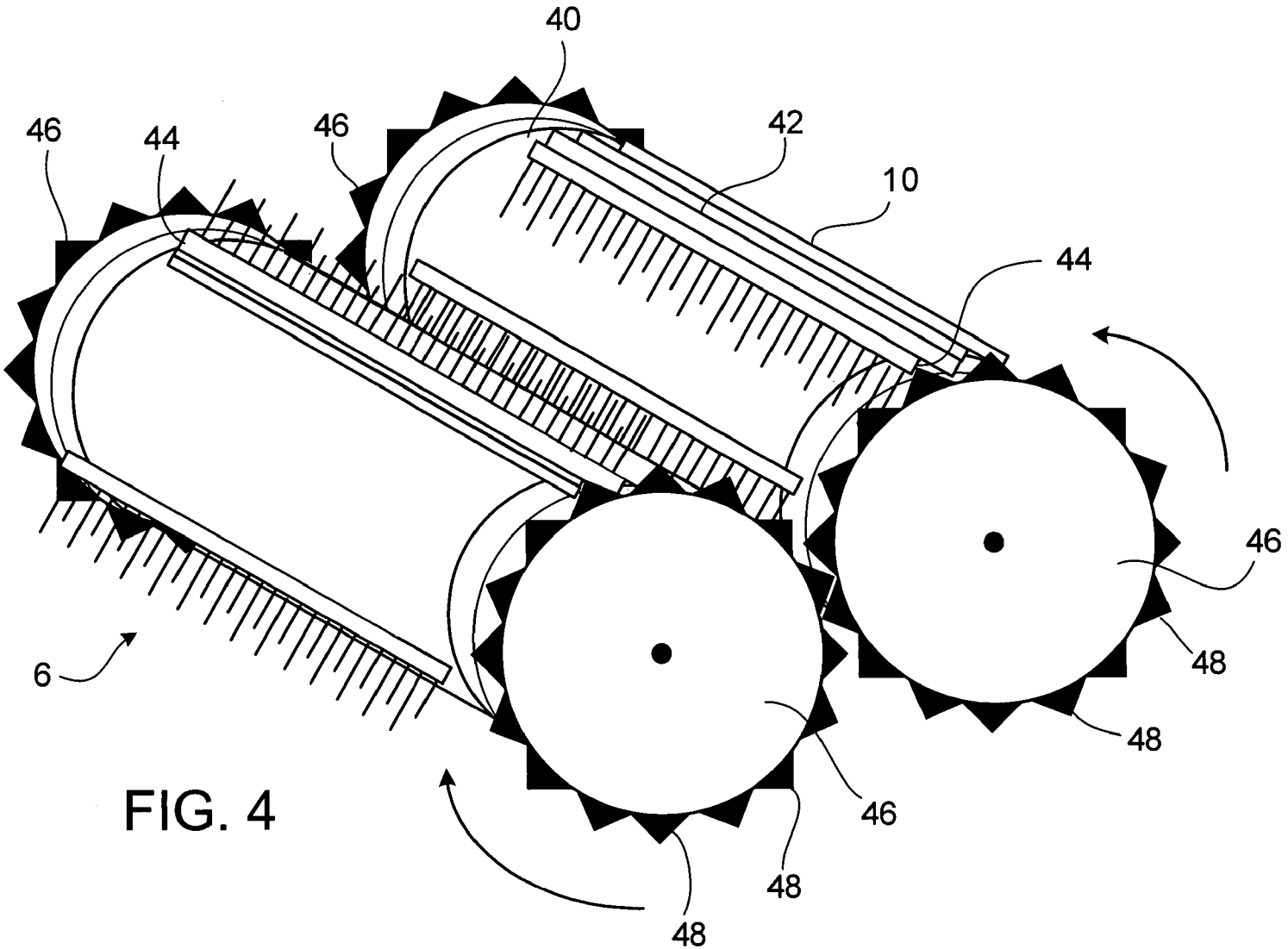
FIG. 4 is a cut-away view of the formation rollers

A primary and secondary formation roller 6 and 8, respectively, assist in forming the sealed pouch 18. As seen in FIG. 4, the rollers 6 and 8 can be cylindrical in shape. Although the primary formation roller 6 is depicted as being of equal size to the secondary formation roller 6, the size, shape and dimensions of the rollers 6 and 8 can vary. The opposite ends 46 of the rollers 6 and 8 can have engagement mechanisms 48, such as grooves, serrations or teeth, like a gear, to permit the rollers to engage one another, as well as the movement mechanism 12. The cylindrical face of either or both rollers 6 and 8 has one or more cavities 40 for allowing waste, enveloped by the collecting pouch material 20, to pass in between them. A formation bridge or bridges 42 can be used to press the material together as the enveloped waste passes through the cavities 40. Formation bridges 42 can run along or near the top, bottom and sides of the cavities 40. As the rollers 5 and 6 rotate in their respective opposite directions, as shown by the arrows in FIG. 4, their respective formation bridges 42 align so that when the enveloped waste passes through the cavity 40, the formation bridges 42 press the pouch material 20 together, causing anterior, posterior and side seals along the pouch. The number of rotations the rollers 6 and 8 make in order to align the formation bridges 42 will depend on their size and shape. For example, if the primary formation roller 6 is larger than the secondary rollers 6, then the secondary roller 8 may rotate twice to every one rotation of the primary roller 6. Alternatively, if the rollers 6 and 8 are of equal size, then the rollers 6 and 8 may only be required to each rotate once to align the formation bridges 42. Other variations of this rotation process may also be employed and the number of formation bridges 42 may also vary depending on the sizes of the formation rollers 6 and 8. A locking mechanism (not shown) can also be employed on either or both of the formation rollers 6 and 8 to limit them to move only in one direction.

Formation of the sealed pouch 18 may also be accomplished by employing only one formation roller 6 or 8. For example, a plate or scoop 50 (not shown) can be positioned opposite to and compliment the sole formation roller 6 or 8 to allow the enveloped object to pass in between them while forming the sealed pouch 18. The plate or scoop 50 can extend beyond the bottom of the housing to facilitate a dust-shovel/broom type action. Further still, more than two formation rollers can be employed to form the sealed pouch.

The apparatus can also employ grasping mechanisms for grasping and enveloping the object, such as flaps or brushes 44. As illustrated in FIG. 4, the brushes 44 can be attached to the rollers 6 and 8. Alternatively, however, the brushes 44 can be employed on separate rollers or devices (not shown) that engage the formation rollers 6 and 8 or movement mechanism 12 and facilitate grasping and enveloping motion of the brushes 44.

The cutting unit 10 is designed to sever the sealed pouch. As illustrated in FIG. 4, the cutting unit can be a blade that runs parallel to the bottom formation bridge 42 of the major formation roller 6. Accordingly, when the corresponding bottom formation bridges 42 of the rollers 6 and 8 form the posterior and final seal of the collection pouch 18, the cutting unit 10 severs the pouch 18 as the formation rollers 6 and 8 continue to rotate. Although the cutting unit 10 can be employed on either formation roller 6 or 8, it can also be a separate unit attached to the housing unit 2 and positioned to sever the sealed collection pouch 18 after it passes through the formation rollers 6 and 8. Still further, a cutting unit could be movably attached to the housing by a string, chain or similar device, which would permit the user to manually cut the pouches off as necessary. Obviously, more than one or different variations of the cutting unit 10 can be employed to sever of the pouch. The pouches may be allowed to continue as a string of pouches until all of them are cut off at once.

An actuation device, such as a common motor 14, and a movement mechanism, such as a main gear 12, can drive formation rollers 8 and 10. The common motor 14 engages and drives a main gear 12.

Figure 6:
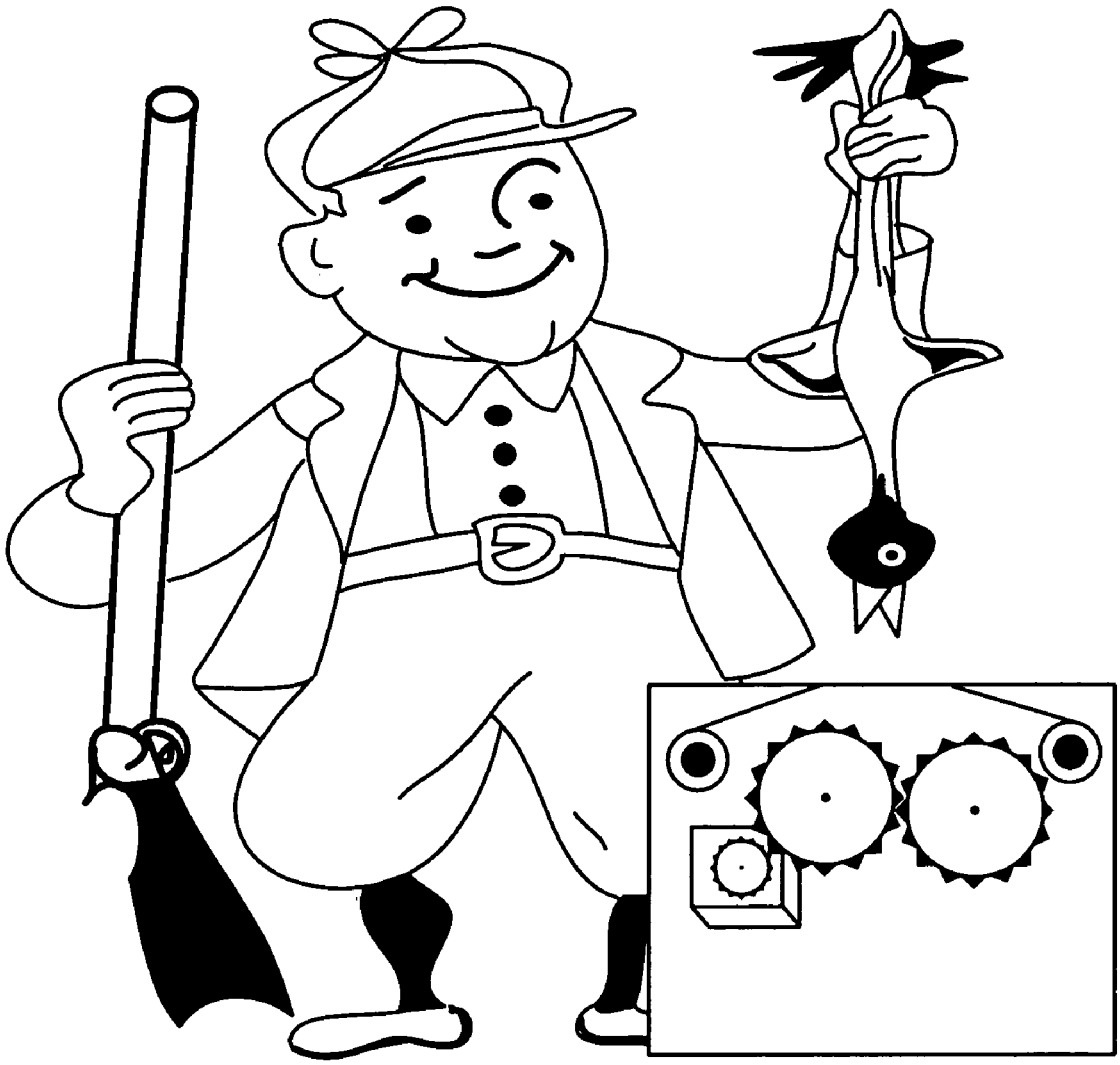
FIG. 6 is a view of the apparatus receiving an object for packaging and sealing

FIGS. 1-3 illustrate how these components of the apparatus assist in the packaging and sealing cycle, i.e., packaging and sealing the object and forming and storing the sealed pouch 18. In particular, FIG. 1 shows the apparatus in its inactive, starting position. While in this starting position, the apparatus is ready to collect the object, and the material 20 is held taught between the roller shafts 3 and 4 and the bottom formation bridges 42 of the rollers 6 and 8. A user positions the desired object in the opening 16 of the housing unit 2, as illustrated in FIG. 6. When the user activates the motor via the on "On/Off" switch 12 to the "On" position, the main gear 12 turns clockwise, engaging and driving the major formation roller 6 causing it to turn in a counterclockwise direction, which in turn engages the minor formation roller 8 causing it to turn in the opposite, clockwise direction. As the rollers 6 and 8 rotate in opposite directions, they envelope the object. If brushes 44 are employed on the rollers 6 and 8, the brushes 44 move in an outward-inward circular converging sweeping and grasping motion. When the brushes 44 contact the interior side of the pouch material 20, the sweeping and grasping motion cause the collection material 20 to envelope the waste as the brushes 44 converge. The object is then enveloped by the material, sealed and moved through and severed by the formation rollers 6 and 8. The motor may be also maintained in an "automatic-on" state, whereby it automatically activates when an object is positioned in the opening 18.

As the movement mechanism 16 continues to rotate, as illustrated in FIG. 2, the formation rollers 6 and 8 continue to rotate and envelope the object between the rollers cavities 40 (See FIG. 4). When the rollers 6 and 8 rotate to where the bottom formation bridges 42 of the roller cavities 40 engage, the anterior seal of the pouch is formed. As the roller 6 and 8 continue to rotate, and the side formation bridges 42 engage, the sides of the pouch are sealed. Finally, when the bottom formation bridges 42 engage as the formation rollers 6 and 8 continue to rotate, the posterior seal of the pouch is formed and thereafter severed by the cutting unit 10. Brushes 44 may be employed to assist in moving the enveloped object through the sealing and severing process.

After the sealed pouch 18 is severed, it passes through the chute 26 into the extraneous container or into the one or more storage compartments 22. Alternatively, the sealed pouch 18 may slide along or within a guide mechanism, such as a top and/or bottom tongue or lip (FIG. 7) that terminates at the opening of the one or more storage compartments 22, where the pouch is deposited until removed. The guidance mechanism may be designed at a downwardly sloping angle to facilitate movement of the sealed pouch 8 into the one or more storage compartments 22. Still further, the movement mechanism 16 may also drive guidance mechanisms, such as guidance rollers (FIG. 8) that are configured in the same fashion as the formation rollers 6 and 8 and which, in lieu of or in addition to the chute 18, actively moves the sealed pouch 8 into the one or more storage compartments 22 or the extraneous container.

Even though the sealed pouch 18 has been severed, the adhesive sides of the pouch material 20 have been pressed together during the pouch formation process, forming a tab-like configuration 32 in the material 20, allowing it to retain a continuous strip form. The tab-like configuration 32 is formed when the portion of the pouch material 20 just behind the severed pouch 18 is sealed together by the formation bridges 42 of the rollers 6 and 8. Accordingly, when the motor deactivates either automatically or by turning the "On/Off" switch 12 to the "Off" position, and the apparatus returns to its open position, as illustrated in FIG. 1, the tab-like configuration 32 remains pinched between the bottom formation bridges 42 of the rollers 6 and 8, keeping the pouch material 20 taught and readying the apparatus for its next collection cycle. When a user loads new material pouch cartridges, he can manually create the tab-like configuration and feed it into the formation rollers 6 and 8 to ready the apparatus, or he can run the apparatus through a collection cycle as shown in FIGS. 1 through 3. There are of course other various ways to ready the apparatus after first loading the pouch material cartridges. Moreover, the tab-like configuration 32 can be formed by interlocking ridges or other similar mechanisms in the pouch material 20, and the pinching action described can be accomplished by employing only one formation roller 6 or 8 and a complimenting scoop or plate 50.

Figure 7:
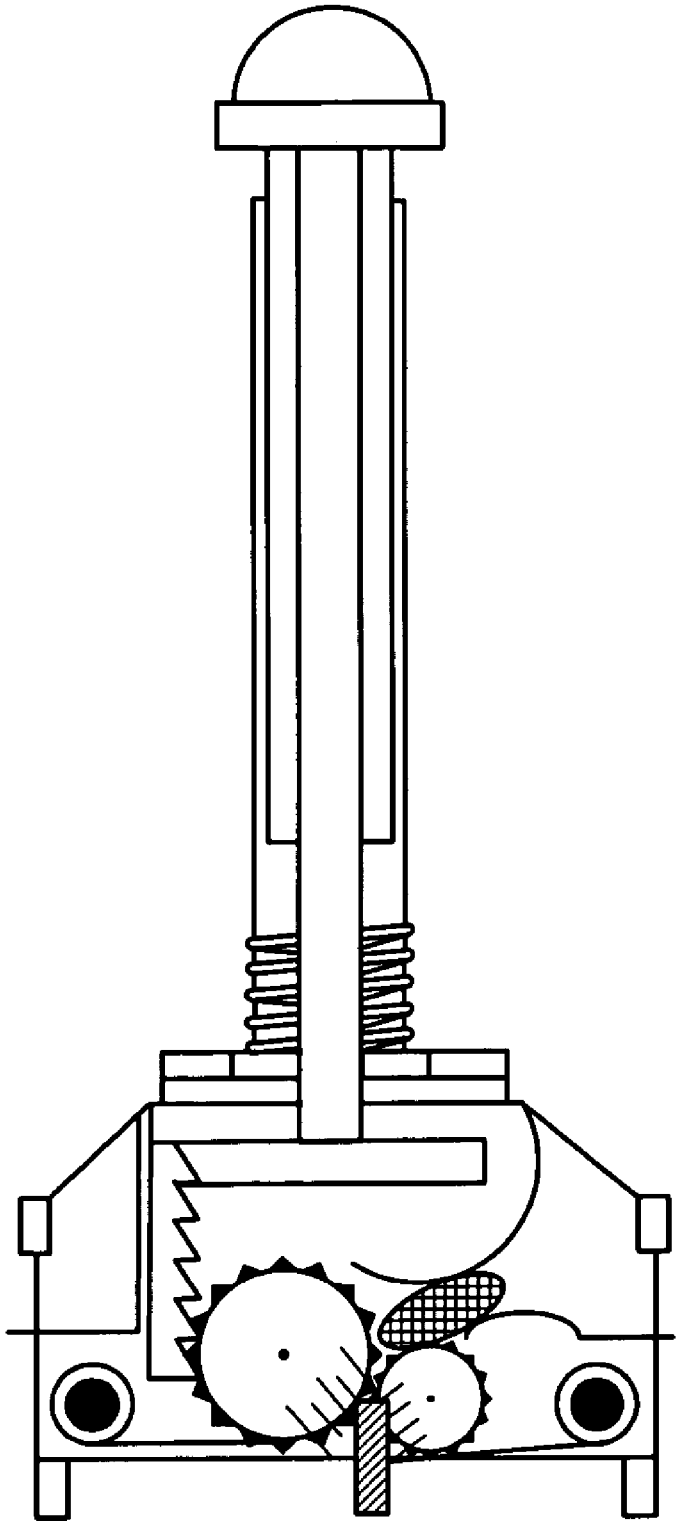
FIG. 7 shows alternate components of the apparatus
Figure 8:
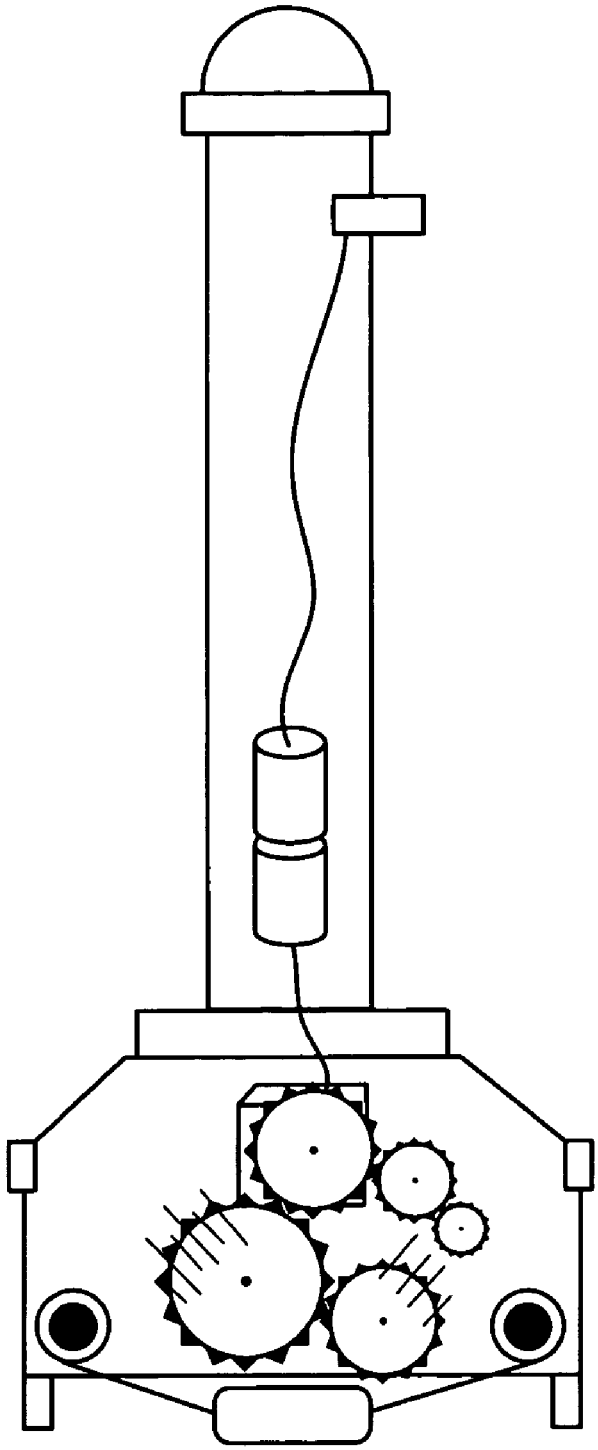
FIG. 8 shows an alternate component of the apparatus FIG. 9 shown a cut-away view of another implementation of the apparatus.
Figure 9:
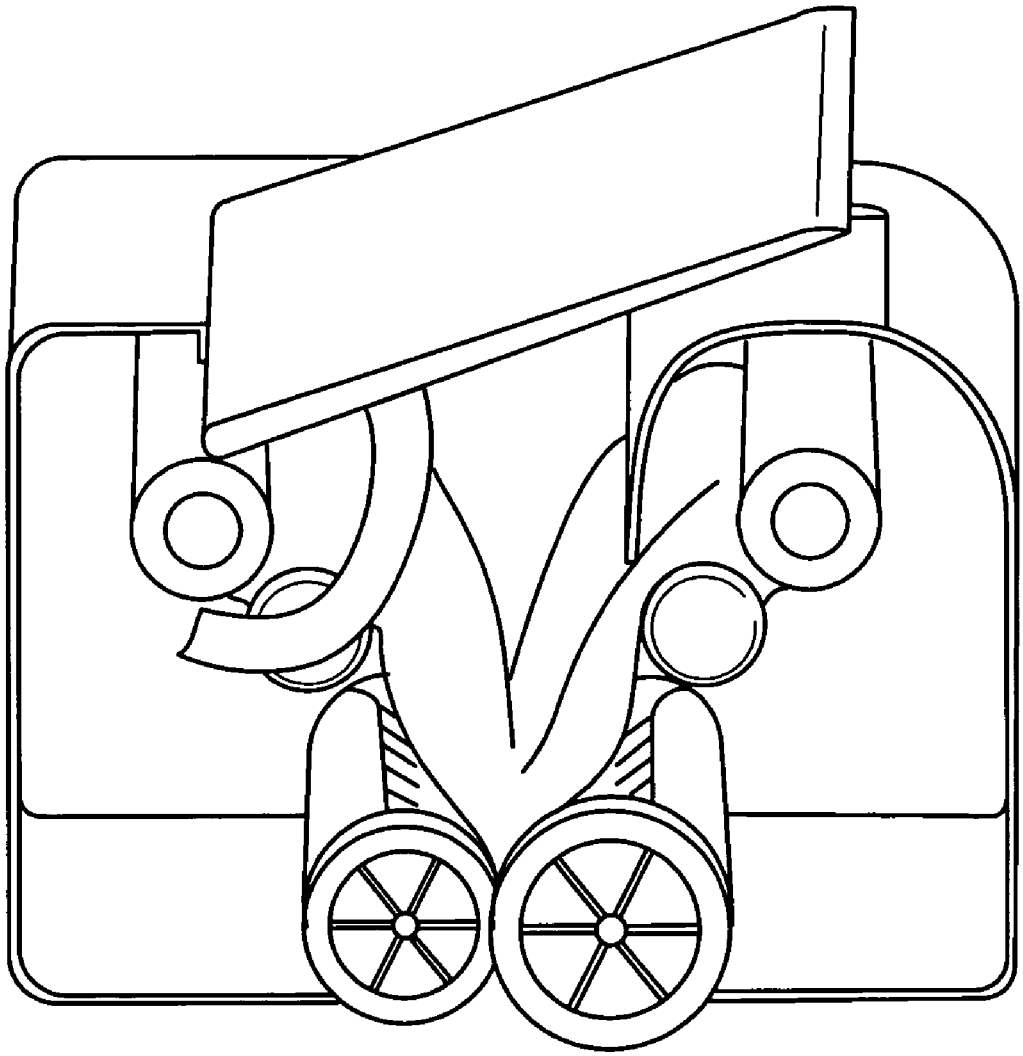

Another implementation of the apparatus is contemplated as illustrated in FIG. 7. In this implementation, the movement mechanism is an actuator rod 52. The rod 52 can have teeth, grooves or serrations 56 to engage and drive the one or more formation rollers 6 and 8 in same fashion as the motor 14 and main gear 12 of the previous embodiment. For example, the actuator rod can have biasing means, such as a spring 100, allowing the user to depress the rod 52 by way of a lever or button 102 until the packaging and sealing cycle is complete, at which time the button 102 is released and the rod retracts and the apparatus returns to its open, in active position. Similarly, as seen in FIG. 9, the door hinge of the apparatus can act as the actuator rod to either drive the rollers or to provide spring action that stores the power as the door is closing and then releases the power once the door is fully closed.

The invention claimed is:

1. An apparatus for collecting and pouching an object comprising the following:

a housing unit;

a first and second material rollers for dispensing first and second opposing material webs;

first and second formation rollers including a sealing bridge mounted thereon;

a grasping mechanism comprising brushes and flaps mounted on at least one of the formation rollers;

a movement mechanism, actuated by an actuation device, for moving at least one of the formation rollers for facilitating the collection and enveloping of an object in the opposing material webs to form at least one sealed pouch; and at least one cutting unit for severing the at least one sealed pouch.

2. The apparatus of claim 1 wherein the housing unit has at least one storage compartment.

3. The apparatus of claim 2 comprising a guidance mechanism for facilitating movement of the sealed pouch into the storage compartment. The brushes and/or flaps located directly on the formation rollers facilitate the movement of the pouch as it passes through the rollers, thereby avoiding the need for additional rollers, An apparatus for collecting and pouching an object comprising the following: a housing unit with at least one storage compartment; at least one material roller for dispensing a material; a movement mechanism, actuated by an actuation device, for moving at least one formation roller for facilitating the collection and enveloping of the object in the material to form a sealed pouch; and at least one cutting unit for severing the sealed pouch; at least one grasping mechanism; and a guidance mechanism for facilitating movement of the at least one sealed pouch into the storage compartment.

The grasping mechanism are the brushes and/or flaps located directly on the formation rollers to facilitate the movement of the pouch as it passes through the formation rollers which also seal the material; thereby avoiding the need for additional rollers that would otherwise handle the two functions of grasping the material and sealing it.

4. The apparatus of claim 1 wherein the housing unit has a chute for facilitating movement of the sealed pouch into a storage container configured to receive the housing unit.

5. An apparatus for collecting and pouching an object comprising the following:

a housing unit with at least one storage compartment;

a first and second material rollers for dispensing a first and second opposing material webs;

first and second formation rollers including a sealing bridge mounted thereon;

a movement mechanism, actuated by an actuation device, for moving at least one of the formation rollers for facilitating the collection and enveloping of an object in the opposing material webs to form a sealed pouch;

at least one cutting unit for severing the sealed pouch;

at least one grasping mechanism comprising brushes and flaps mounted on at least one of the formation rollers; and a guidance mechanism for facilitating movement of the at least one sealed pouch into the storage compartment.

6. An apparatus for collecting, pouching and storing an object comprising:

a housing unit;

first and second material rollers for dispensing a first and second opposing collection material;

first and second formation rollers including a sealing bridge mounted thereon;

a grasping mechanism comprising brushes and flaps mounted on at least one of the formation rollers;

a movement mechanism, actuated by a power-driven device, for moving at least one of the formation rollers for facilitating the collection and enveloping of an object in the opposing collection material to form at least one sealed pouch; and at least one cutting unit for severing the at least one sealed pouch.

7. The apparatus of claim 6 wherein the housing unit has at least one storage compartment.

8. The apparatus of claim 7 comprising a guidance mechanism for facilitating movement of the sealed pouch into the storage compartment.

* * * * *